US006062115A

United States Patent [19]

Bares et al.

[11] Patent Number: 6,062,115

[45] Date of Patent: May 16, 2000

[54] AUDIBLE SIGNAL TORQUE WRENCH

[75] Inventors: Jack A. Bares, Chagrin Falls; James R. Jeromson, Jr., Aurora, both of Ohio

[73] Assignee: Meritool Corporation, Chagrin Falls, Ohio

[21] Appl. No.: 09/052,198

[22] Filed: Mar. 31, 1998

Related U.S. Application Data

[60] Provisional application No. 60/043,138, Apr. 14, 1997.

[51] Int. Cl.[7] ..... B25B 23/159

[52] U.S. Cl. ..... 81/481; 81/477

[58] Field of Search ..... 81/467, 477, 478, 81/479, 480, 481

[56] References Cited

U.S. PATENT DOCUMENTS

| | | | |
|---|---|---|---|
| 1,512,192 | 10/1924 | Benko | 81/481 |
| 2,122,760 | 7/1938 | Scott et al. | 81/477 |
| 2,371,901 | 3/1945 | Livermont | 81/477 |
| 2,400,205 | 5/1946 | Livermont | 81/477 |
| 3,357,284 | 12/1967 | Van Hoose | 81/478 |
| 3,608,403 | 9/1971 | Green | 81/477 |
| 3,763,724 | 10/1973 | Green | 81/477 |
| 3,847,038 | 11/1974 | Green | 81/477 |
| 4,403,530 | 9/1983 | Biddle | 81/478 |
| 5,123,289 | 6/1992 | Potesta . | |
| 5,152,200 | 10/1992 | Kaplan | 81/478 |

*Primary Examiner*—David A. Scherbel
*Assistant Examiner*—Joni B. Danganan
*Attorney, Agent, or Firm*—Vickers, Daniels & Young

[57] ABSTRACT

An audible torque wrench including a head having a tool connecting part. A handle is operatively attached to the head in order to cause rotation thereof. A grip is pivotably attached at one of its ends to the handle. A spring is fastened between the grip and the handle at the end opposite the pivot on the grip. The spring is mounted so that it may be moved longitudinally along the length of the handle in order to change the torque settings for the wrench. An audible clicker spring is fastened to either the handle or the grip at a position between them so that when a force is applied to the grip, to rotate it about the head, the grip compresses the spring and biases the resilient member until it reaches the position where an audible signal is made.

12 Claims, 2 Drawing Sheets

AUDIBLE SIGNAL TORQUE WRENCH

This application claims the benefit of U.S. Provisional Application Ser. No. 60/043,138, filed Apr. 14, 1997.

BACKGROUND OF THE INVENTION

Torque wrenches are well-known devices to insure the accuracy of tightening a bolt or nut. They generally have a head, a handle, an internal spring in the handle and external adjustment means. The range of adjustment is usually limited by the spring. Any drastic changes in the range of the torque wrench are difficult to make and, as a practical matter, impossible for the average user. They are relatively expensive and difficult to manufacture.

This invention solves the problems of the prior art by making a simple inexpensive, adjustable torque wrench. The torque wrench of this invention includes a head, a handle attached to the head and a pivoted grip which fits over the handle. A main spring is placed near the end of the handle and is located between the grip and the handle. The main spring may be readily changed since it is accessible without any other disassembly. The main spring itself may be moved toward and away from the handle or simply replaced and thus adds a large degree of adjustability. Located between the main spring and the pivot on the grip is a clicker spring. The clicker spring is mounted in a slot on either the handle or the grip. It moves within a slot and is easily adjustable. Movement of the clicker spring toward and away from the head changes the torque setting at which the clicker spring makes a noise indicating the proper torque has been reached.

SUMMARY OF THE INVENTION

A torque wrench having a head, a handle attached thereto and a pivoted grip over the handle. A replaceable and moveable main spring is mounted between the handle and the grip at a position near the end of the handle. A clicker spring is moveable within a slot in the grip or the handle and is located therebetween. The clicker spring is positioned between the main spring and the pivot of the grip with the handle.

DESCRIPTION OF THE PREFERRED EMBODIMENTS

Figure 1:
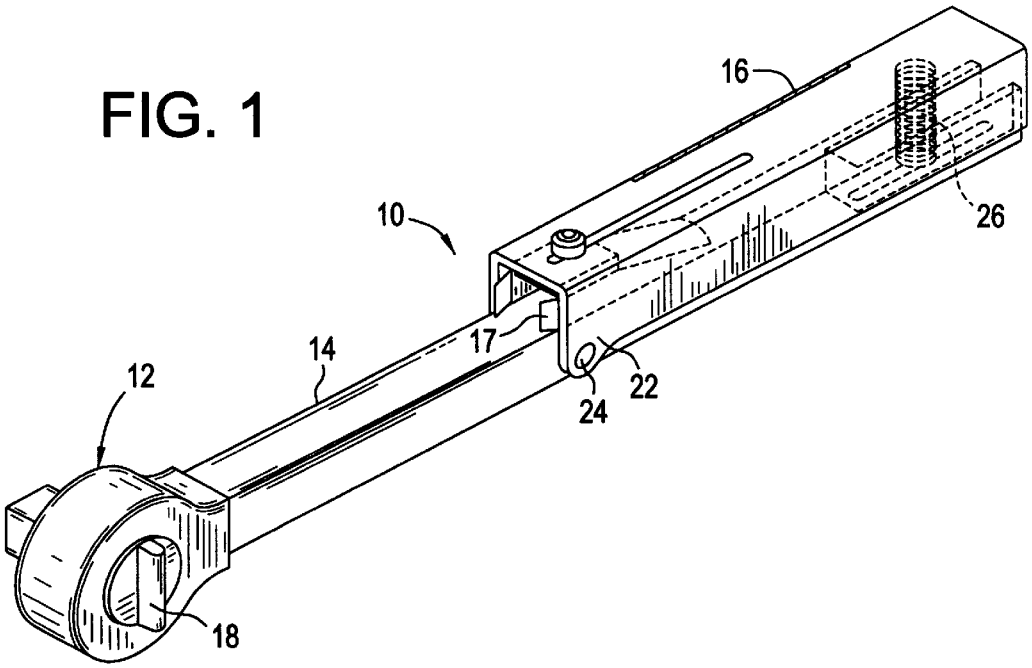
FIG. 1 is a perspective view of the torque wrench of this invention.

A torque wrench 10 includes a head 12, a handle 14 and a grip 16. The head 12 has a conventional design with a reversing mechanism governed by the position of a selector 18. A removable socket is typically attached to head 12 to grasp a nut or bolt.

The handle 14 is shown as a bar with a rectangular cross-section. However, it may be any shape well known in the art such as tubular with varying diameters.

A channel-shaped grip 16 is sized to fit over the handle 14. The front part of the grip 16 has downwardly projecting tabs

22 through which pivotable fasteners 24 (only one shown) are placed to secure it rotatably to the handle 14. The fasteners 24 may be any known devices such as shafts, bolts, screws, pins or other devices for securely fastening one end of the grip 16 to the handle 14 while permitting their relative rotation while pivoting freely without binding. The tabs 22 are not absolutely necessary. The apertures for the fastener 24 could be placed in the main body of the grip 16. Tabs 17 limit the maximum opening of the grip 16 from the handle 14.

Figure 5:
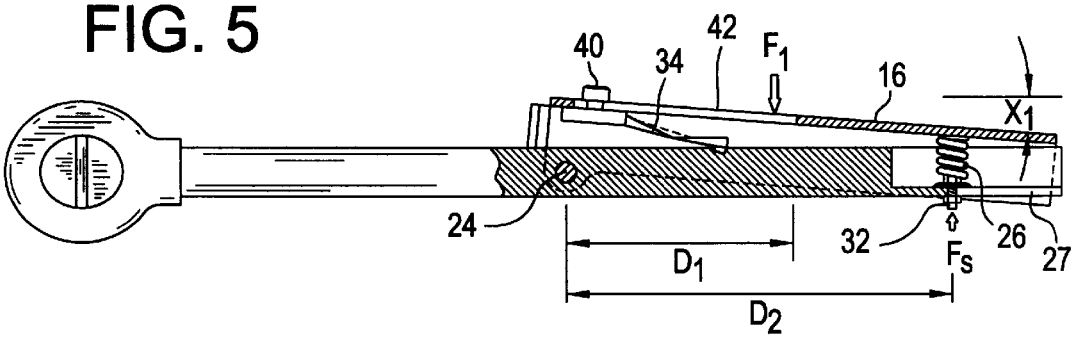
FIGS. 5 and 6 are a top view of FIG. 1 in partial cross section showing the relative motion of the parts.

A main spring 26 is positioned near the end of the grip 16 which is opposite the pivotable fastener(s) 24. The main spring 26 may be a coiled spring, leaf spring or other resilient member that is compressible in a predictable, repeatable, measurable manner. At least one end of the main spring 20 must be fastened to the grip or handle and be positioned between them. Preferably one end 28 of the main spring 26 is fastened to the handle 14. In this manner, the grip 16 would remain in proximity to the handle 14 and swing from the fastener(s) 24. The strength of the main spring 26 would be selected as the primary force to be overcome in the use of this torque wrench. Its actual strength would be selected according to its intended use. It is well known that the force ($F_S$) in a spring is equal to a constant ($k_S$) multiplied by the distance it deflects ($X_1$), or otherwise moves (FIG. 5). Thus for $F_S=K_SX_1$, K is typically selected to create a force F from one pound to three hundred pounds although others could be used.

$F_1$ and $D_1$ are shown at a typical average place where the force $F_1$ occurs. The force actually is spread over the width of the user's hand. A four inch length of the handle is a Military Standard.

Figure 2:
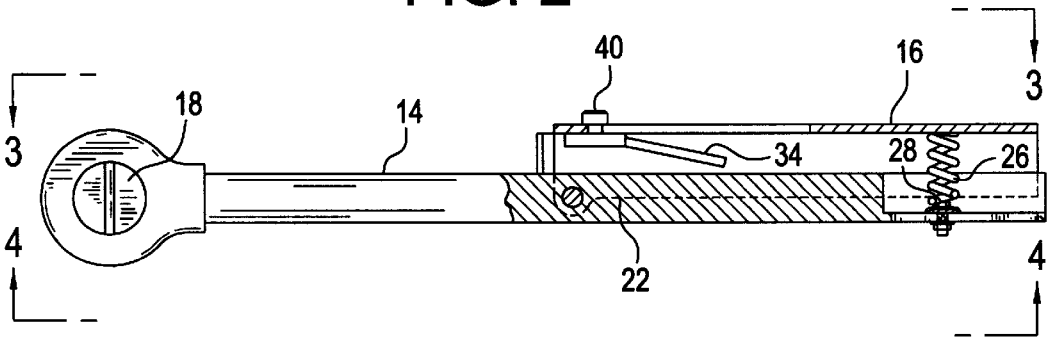
FIG. 2 is a top view of FIG. 1.

It is an advantage of this invention that the main spring 26 could be changed for different uses. This easy interchangeability of main spring 26 gives this invention a versatility heretofore unknown. It is only necessary to unscrew or otherwise release the end(s) of the main spring 26 by means of a fastener 32 (FIGS. 2 and 2A) remove it and replace it with one of a different strength or constant (k).

Figure 4:
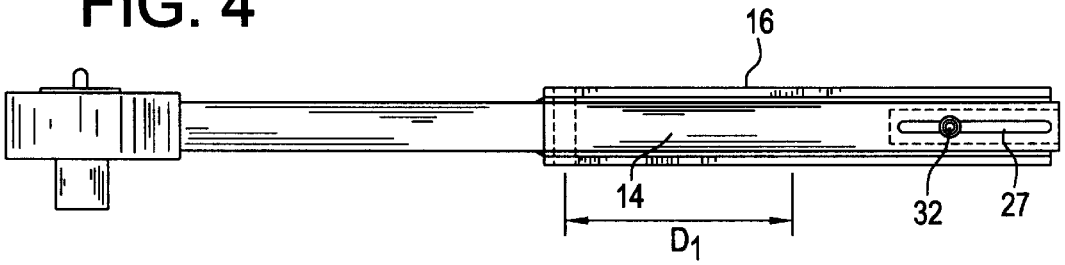
FIG. 4 is a view 4—4 of FIG. 2.

It is also within the scope of this invention to allow the main spring 26 to be slideable along the length of the grip 16 and handle 14. It is only necessary to loosen the fastener 32, slide the spring 26 along the slot 27 and tightening the fastener 32. This variation would cause a change in the distance ($D_2$) (FIG. 5) and thus the torque $T_1$. $T_1$ is generated by the force $F_1$ (FIG. 5) multiplied by the distance $D_1$ or $T_1=F_1D_1$. This must also equal the force of the spring Fs multiplied by $D_2$ thus $F_1D_1=F_SD_2$ Variations of the force and thus the torque can be made by allowing the main spring 26 to move along the length of the handle 14 (FIGS. 4 and 5). As the main spring 26 moves closer to the head, the force $F_S$ required to compress it will increase if the user grasps the same point on the grip. Since $F_1D_1=F_SD_2$ in equilibrium, as the distance $D_2$ is reduced, Fs must increase before the clicker is actuated.

Fine adjustments and a clicking noise are supplied by a clicker spring 34 (FIG. 2A and 2B) having one end 35 mounted in a clicker block 36 slideably mounted in the grip 16 on handle 14. The other end of the clicker spring 34 engages the opposite piece 14. The clicker spring 34 is normally made of spring steel and shaped to make a clicking noise when it is bent to a preselected position. Other noise makers may also be provided if they do so at a consistent preselected position and/or force. The clicker spring is basically a leaf spring but it may have other shapes such as a coil. The clicker spring normally does not take a significant force to bend relative to the main spring 26. Such force is usually less than a few pounds. However, it may also be changed to provide a different range of forces. The clicker may also be preloaded to a certain force by compression between the grip and handle before the main spring 26 is compressed.

Figure 2A:
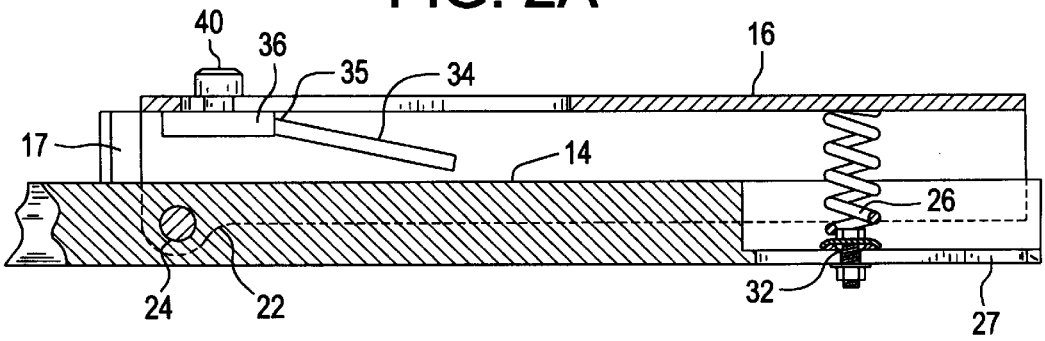
FIG. 2A is an enlargement of part of FIG. 2.
Figure 2B:
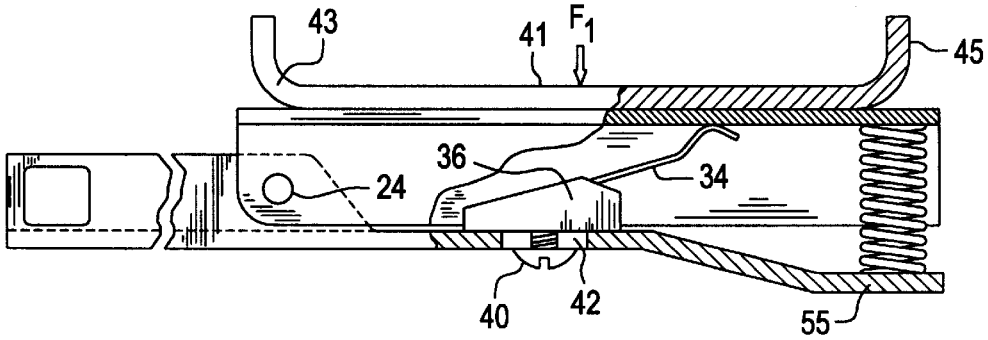
FIG. 2B is an alternate of FIG. 2A.
Figure 3:
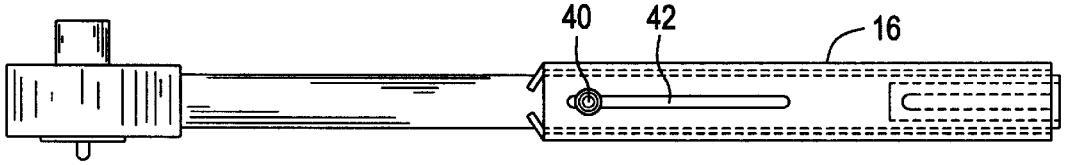
FIG. 3 is a view 3—3 of FIG. 2.

FIG. 2B illustrates an alternate of FIG. 2A and the same numbers are used for similar parts. In this embodiment, the main spring 26 is supported between the grip 16 and a flared base 55 in the handle 14. This allows greater deflection of the main spring 26. The clicker spring 34 is attached to the handle by the same mechanism as FIG. 2A and is moveable in a slot 42. The advantage of the embodiment is that the clicker mount does not interfere with the grip. FIG. 2B further illustrates a hand locator 41 with upwardly turned flanges 43 and 45. It is adhered or fastened to the grip 16. The hand locator is usually about 4" long since that is an accepted standard. The flanges 43 and 45 not only ensure correct placement of the hand but also reduces slippage of the hand. Correct hand placement assures greater accuracy of the torque wrench. That is, the average force location $F_1$ will constantly be at or near the center of the grip 41. The grip 41 could also be used on the other embodiments herein.

A locking screw 40 or other fastener is attached to and holds the clicker block 36 to the grip 16 or to the handle 14. A slot 42 in the grip 16 through which the locking screw 40 passes allows movement of the clicker block 36 and clicker spring 34 along the length of the handle 14. As shown in FIG. 5, the clicker 34 will make a noise when the main spring deflects a distance $X_1$ which represents a force $F_1$ on the main spring 26. $F_1$ in FIG. 5 is generally the maximum force possible with a given main spring in a given location. Thus, when the clicker spring 34 is closest to the head, the maximum force must be used.

Figure 6:
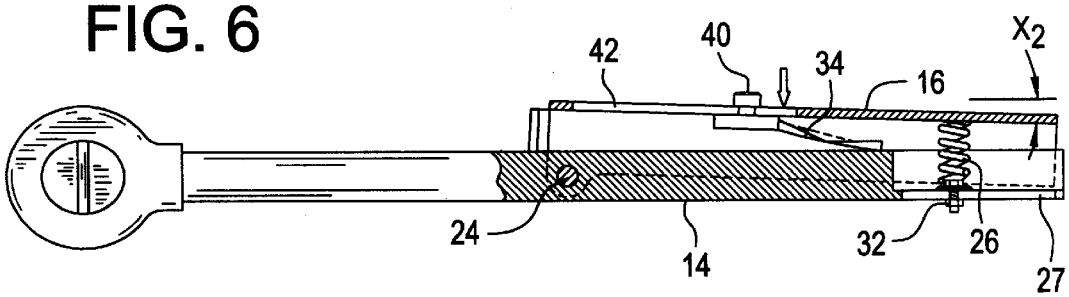

The minimum force $F_1$ for a given position of main spring 24 is set on the torque wrench by moving the clicker spring to a position closest to the main spring 26 (FIG. 6). In this position, a relatively small movement of the grip 16 causes a deflection $X_2$ to activate the clicker 34. This occurs simply because of the geometry of the grip being pivoted at 24. The closer the clicker spring 34 is to pivot 24, the more the main spring 26 has to be compressed and the greater the force F has to be before the click is heard. The positions of the clicker spring 34 would normally be calibrated between those shown in FIGS. 5 and 6.

It is also anticipated that a coil or loop spring could be placed at the pivot 24 and work in a similar manner. One end of the coil spring would engage the handle 14, the other end would engage the grip 16 and the pivot 24 would be in its center. A leaf spring could also replace the main coil spring 26 at about the same location.

Many different sizes and torque ranges are possible. One embodiment found useful utilizes a torque arm length of approximately 12". The torque arm length is the distance from the drive socket to the center of the grip. The main spring 26 may be made of music wire having a diameter of 0.060" formed in 10 active coils having an inner diameter of 0.315" and a free height of about 1.1" and a compressed height of about 0.72". These components produce a torque in the range of about 25 pounds. Obviously there will be a range involved.

This invention, because of its ingenious simplicity is not only very versatile but much less complex, has fewer working parts and is less expensive to manufacture than the prior art. It can be calibrated over a wide range of torques and such range may be changed. Other torque wrenches have enclosed parts which make them much harder to disassemble for repair or alteration.

The present disclosure describes several embodiments of the invention, however, the invention is not limited to these embodiments. Other variations are contemplated to be within the spirit and scope of the invention and appended claims.

What is claimed is:

1. An audible torque wrench comprising:

a head having a tool connecting part;

a handle operatively attached to the head;

a grip attached to the handle such that the handle extends along a major portion of the length of the grip;

a resilient member located between and fastened between the grip and the handle, the strength and position of which contributes to the force necessary to use the torque wrench;

an audible noise maker located between the grip and the handle fastened to one of the handle and the grip so that when a force is applied to the grip to rotate the handle about the head, the grip deflects the resilient member until a position is reached where the audible noise maker is actuated and an audible signal is produced.

2. The audible torque wrench of claim 1 wherein the resilient member is a spring.

3. The audible torque wrench of claim 2 wherein the audible noise maker is a clicker spring which is slideably mounted on one of the grip and the handle so that one end of the clicker spring engages one of the handle or the grip and gives off an audible signal when the grip is deflected by a predetermined amount, the location of the clicker spring determining at least in part the amount of torque that must be applied before the audible signal is generated.

4. The audible torque wrench of claim 2 wherein one end of the spring is fastened to one of the handle and grip and is moveable to different positions thereon in order to vary the torque necessary to actuate the audible noise maker.

5. The audible torque wrench of claim 2 wherein the audible noise maker is a clicker spring that is slideably mounted to the handle to move along the length of the handle, the position of the clicker spring at least in part determining the amount of torque that must be applied to the grip before an audible signal is heard.

6. The audible torque wrench of claim 5 wherein a hand locator engages and is attached to the grip in order to encourage the user to apply the force in the correct location along the handle.

7. The audible torque wrench of claim 2 wherein the grip is a channel-shaped member fitting over the handle and the grip is pivotably attached at one end to the handle.

8. An audible torque wrench comprising:

a head having a tool connecting part;

a handle operatively attached to the head;

a grip attached to the handle;

a resilient member fastened between the grip and the handle, the strength and position of which contributes to the force necessary to use the torque wrench;

an audible noise maker fastened to one of the handle and the grip so that when a force is applied to the grip to rotate the handle about the head, the grip biases the resilient member until a position is reached where the audible noise maker is actuated and an audible signal is produced, the resilient member being a spring, the audible noise maker being a clicker spring which is slideably mounted on one of the grip and the handle so that one end of the clicker spring engages one of the handle and the grip and gives off an audible signal when the grip is deflected by a predetermined amount, the location of the clicker spring determining at least in part the amount of torque that must be applied before the audible signal is generated, the clicker spring being attached to a clicker block, a groove being located along the longitudinal axis of the grip and the clicker block being moveable along the groove to vary the torque which is necessary to create an audible signal from the clicker spring.

9. An audible torque wrench comprising:

a head having a tool connecting part;

a handle operatively attached to the head;

a grip attached to the handle;

a spring fastened between the grip and the handle, the strength and position of which contributes to the force necessary to use the torque wrench;

an audible noise maker fastened to one of the handle and the grip so that when a force is applied to the grip to rotate the grip about the head, the grip biases the spring until a position is reached where the audible noise maker is actuated and an audible signal is produced, the audible noise maker being a clicker spring which is slideably mounted on one of the grip and the handle so that one end of the clicker spring engages one of the handle and the grip and gives off an audible signal when the grip is deflected by a predetermined amount, the location of the clicker spring determining at least in part the amount of torque that must be applied before the audible signal is generated, one end of the spring being fastened to one of the handle and grip and being moveable to different positions thereon in order to vary the torque necessary to actuate the clicker spring.

10. An audible torque wrench comprising:

a head having a tool connecting part;

a handle operatively attached to the head;

a grip attached to the handle;

a coil spring located and fastened between the grip and the handle with the axis of the coil spring generally perpendicular to the handle, the strength and position of which contributes to the force necessary to use the torque wrench;

an audible noise maker fastened to one of the handle and the grip so that when a force is applied to the grip to rotate the handle about the head, the grip deflects the coil spring until a position is reached where the audible noise maker is actuated and an audible signal is produced.

11. The audible torque wrench of claim 10 wherein the coil spring is located adjacent an end of the handle remote from the head.

12. The audible torque wrench of claim 11 wherein the audible noise maker is a clicker spring adjacent an end of the grip remote from the coil spring.

* * * * *